US006664725B2

(12) United States Patent
Shiroishi et al.

(10) Patent No.: US 6,664,725 B2
(45) Date of Patent: Dec. 16, 2003

(54) CRT ELECTRON GUN WITH A PLURALITY OF ELECTRODES

(75) Inventors: Tetsuya Shiroishi, Tokyo (JP); Syuhei Nakata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 50 days.

(21) Appl. No.: 09/736,389

(22) Filed: Dec. 15, 2000

(65) Prior Publication Data

US 2001/0000942 A1 May 10, 2001

Related U.S. Application Data

(63) Continuation of application No. PCT/JP00/02462, filed on Apr. 14, 2000.

(30) Foreign Application Priority Data

Apr. 15, 1999 (JP) ..... P11-107598

(51) Int. Cl.[7] ..... H01J 29/50

(52) U.S. Cl. ..... 313/414; 313/412; 315/382.1; 348/380

(58) Field of Search ..... 313/414, 409, 313/452; 315/382, 15, 16, 3, 366, 381, 395

(56) References Cited

FOREIGN PATENT DOCUMENTS

| | | |
|---|---|---|
| JP | 60-39741 | 3/1985 |
| JP | 63-259942 | 10/1988 |
| JP | 11-224618 | 8/1999 |

*Primary Examiner*—Vip Patel
*Assistant Examiner*—Kenneth A Berck
(74) *Attorney, Agent, or Firm*—Oblon, Spivak, McClelland, Maier & Neustadt, P.C.

(57) ABSTRACT

A CRT electron gun of the present invention has a cathode for emitting electrons toward a screen as a display face, a G2 electrode to which a voltage higher than that of the cathode is applied, a Gm electrode to which a predetermined voltage is applied, and a G3 electrode to which a voltage higher than that of the G2 electrode is applied, wherein at least those three electrodes are provided with an electron-passing opening and are arranged on the same axis in that order from the side of the cathode, and the potential of the aforementioned cathode is varied to vary the amount of electrons to be drawn; and in this, a configuration is made such that the lowest potential on the axis in a portion where the aforementioned Gm electrode exists substantially agrees with the maximum potential in a range where the potential of the aforementioned cathode varies, and a part of the electrons drawn from the aforementioned cathode flows into at least one of the aforementioned G2 electrode and the aforementioned Gm electrode.

6 Claims, 10 Drawing Sheets

CRT ELECTRON GUN WITH A PLURALITY OF ELECTRODES

This is a Continuation of application No. PCT/JP00/02462 filed Apr. 14, 2000.

TECHNICAL FIELD

The present invention relates to a CRT electron gun; particularly, it relates to a CRT electron gun that allows current for a screen to be obtained at a high sensitivity to a driving voltage.

BACKGROUND ART

Hereinbelow, a description will be given of a conventional CRT electron gun. Matters such as operational conditions will be described with reference to a CRT, which is called a display monitor tube, used for computers and the like. FIG. 8 is a cross-sectional configuration view showing the vicinity of a cathode of a conventional CRT electron gun. In the figure, 1 denotes a cathode for inducing electrons toward a screen, 2 denotes an electron current, 3 denotes a G1 electrode, 4 denotes a G2 electrode, 5 denotes a G3 electrode, and 6 denotes an electron-emitting material provided on a surface of the cathode. In addition, in the conventional electron gun are provided other components, although they are not shown in the figure. For example, there are provided electrodes subsequent to the G3 electrode 5, a G4 electrode, and a G5 electrode. In addition, there are provided overall-configuration items, for example, bead glass pieces for supporting the individual electrodes.

According to the configuration of the present embodiment, the electron gun that allows current for the screen to be drawn at a high sensitivity to the cathode driving voltage can be obtained the same as in Embodiment 1 and, in addition, allows the following effects to be obtained. First of all, electrons are not emitted from a cathode-surface of a portion covered by a metal plate 7, but electrons are emitted only from a portion corresponding to the opening, that is the electron-passing opening; therefore, a load exerting on the cathode can be reduced. In addition, since electrons flowing to the G2 electrode decrease, evaporation of bas that can cause damage on the cathode can be reduced. Futhermore, power consumption can be reduced.

FIG. 9 is an explanatory drawing showing the relationship between a driving voltage and an emission current regarding the conventional CRT electron gun. In the figure, the horizontal axis represents a cathode-modulation voltage (V), which is a variation potential varied from a cathode potential at which the emission current becomes zero; and the vertical axis represents the emission current ($\mu$A). While it differs depending on the size of the CRT, to cause a certain pixel to be luminous at a desired maximum luminance (for example, 100 nit), for example, an electron current of 300 $\mu$A must be caused to flow to the screen. In the conventional electron gun, however, to cause the emission current to vary in a range of 0 to 300 $\mu$A, the cathode voltage must be varied by, for example, about 45 V from about 120 V to about 75 V.

In many cases, individual electron-passing openings in each of a G1 electrode and a G2 electrode are circular, and the central axes of the electron-passing openings are the same. The central axis, which can be assumed to be a rotation-symmetrical axis, is represented by a Z axis. FIG. 10 is an explanatory drawing showing a potential distribution on the Z axis in the vicinity of the cathode in the conventional CRT electron gun when the emission current has reached a level of 300 $\mu$A. A surface of the cathode 1 is assumed to be zero, and the direction of the screen is assumed to be positive. In the figure, the horizontal axis represents the position (mm) on the Z axis from the cathode face in the direction of the screen, and the vertical axis represents the potential (V) on the Z axis. As can be calculated according to a solid line in the graph in the FIG. 10, to obtain the emission current of 300 $\mu$A in the conventional electron gun, an electric field of a $10^5$(V/m) order exists on a front face of the cathode.

Generally, during use of the electron gun under appropriate operational conditions, much electrons exist on the surface of the cathode 1, in which the larger the electric field is applied, the greater amount of current can be obtained; and when the electric field is reduced to be lower than zero, the emission current becomes zero. While the electric field applied to the surface of the cathode can be varied according to the cathode potential, to vary the emission current in the range of 0 to 300 $\mu$A, as described above, the cathode potential must be varied by about 45 V.

As described above, according to the conventional CRT electron gun, compared to a liquid-crystal display, a potential difference of as big as about 45 V must be generated to control the electron current in cases of, for example, 75 V for performing display at the maximum luminance of 100 nit, and 120 V for displaying a black color. Therefore, the conventional CRT electron gun requires a great power to be driven, causing a problem in that, since the width of about 45 V is driven at a high speed, unnecessary electromagnetic waves increase. In addition, in recent years, since even higher resolution display is demanded, the frequency of video signals needs to be even higher; however, an expensive driver circuit is required to implement high-frequency control for a driving voltage of about 45 V.

In addition, recently, demands are increasing for display monitor tubes to display motion images, but, for example, a luminance as high as 300 nit is required for comfortable observation of motion images. This causes difficulty in maintaining existing resolutions, and concurrently, in increasing the driving voltage, therefore causing difficulty in increasing the luminance.

This invention is made to solve the above-described problems caused by the CRT electron gun. An object of the present invention is to obtain an electron gun that allows electron current to be controlled with an inexpensive driver circuit at low voltages, that produces less unnecessary electromagnetic waves, and that is suitable to implement higher-frequency driving when display is performed at a luminance equivalent to a conventional luminance, and that allows current to be obtained for screens at a high sensitivity to a driving voltage that allows several multiples of the conventional luminance to be obtained when display is performed at a driving voltage equivalent to a conventional driving voltage.

DISCLOSURE OF INVENTION

The first CRT electron gun of the present invention has a cathode for emitting electrons toward a screen as a display face, a G2 electode to which a voltage higher than that of the cathode is applied, a Gm electrode to which a predetemined voltage is applied, and a G3 electrode to which a voltage higher than that of the G2 electrode is applied, wherein at least those three electrodes are provided with an electron-passing opening and are arranged on a same axis in that order from a side of the cathode, and a potential of the aforementioned cathode is varied to vary an amount of electrons to be drawn, characterized in that a lowest potential on the axis in a portion where the aforementioned Gm electrode exists substantially agrees with a maximum potential in a range where a potential of the aforementioned cathode varies, and a part of the electrons drawn from the aforementioned cathode flows into at least one of the aforementioned G2 electrode and the aforementioned Gm electrode.

According to the above, electron current can be controlled using inexpensive driving circuits and low voltages, and an electron gun producing a small amount of unnecessary electromagnetic waves can be obtained. Alternatively, an electron gun that allows a high luminance to be obtained without increasing the driving voltage can be obtained.

Also, in the second CRT electron gun according to the present invention, a mental plate that does not emit electrons is provided on a surface of the aforementioned cathode.

According to the above, a load exerting on the cathode can be reduced, electrons flowing to the G2 electrode can be reduced, evaporation of gas that can cause damage on the cathode can be reduced, and furthermore, power consumption can be reduced.

In addition, the third CRT electron gun of the present invention comprises a G1 electrode provided with an electron-passing opening to which a voltage lower than that of the aforementioned cathode is applied, between the aforementioned cathode and the aforementioned G2 electrode.

According to the above, electrons flowing to the G2 electrode can be reduced, evaporation of gas that can cause damage on the cathode can be reduced, and furthermore, power consumption can be reduced.

Furthermore, in the fourth CRT electron gun of the present invention, a screen side of the electron-passing opening of the aforementioned Gm electrode is provided with a circular portion of a larger plate thickness having a central axis identical to a central axis of the electron-passing opening.

According to the above, the diversion angle of electron can be reduced.

Still furthermore, in the fifth CRT electron gun of the present invention, a Gs electrode for preventing variations in potential distribution in the electron-passing opening of the Gm electrode is provided between the aforementioned Gm electrode and the G3 electrode.

According to the above, focus adjustment can easily be implemented.

Still furthermore, in the sixth CRT electron gun of the present invention, the same potential as that of the G2 electrode is applied to the aforementioned Gs electrode.

According to the above, voltage can be applied to the Gs electrode without increasing the number of wirings that are extended to the outside from the inside of a glass vessel of the CRT.

BEST MODE FOR CARRYING OUT THE INVENTION

Embodiment 1

Figure 1:
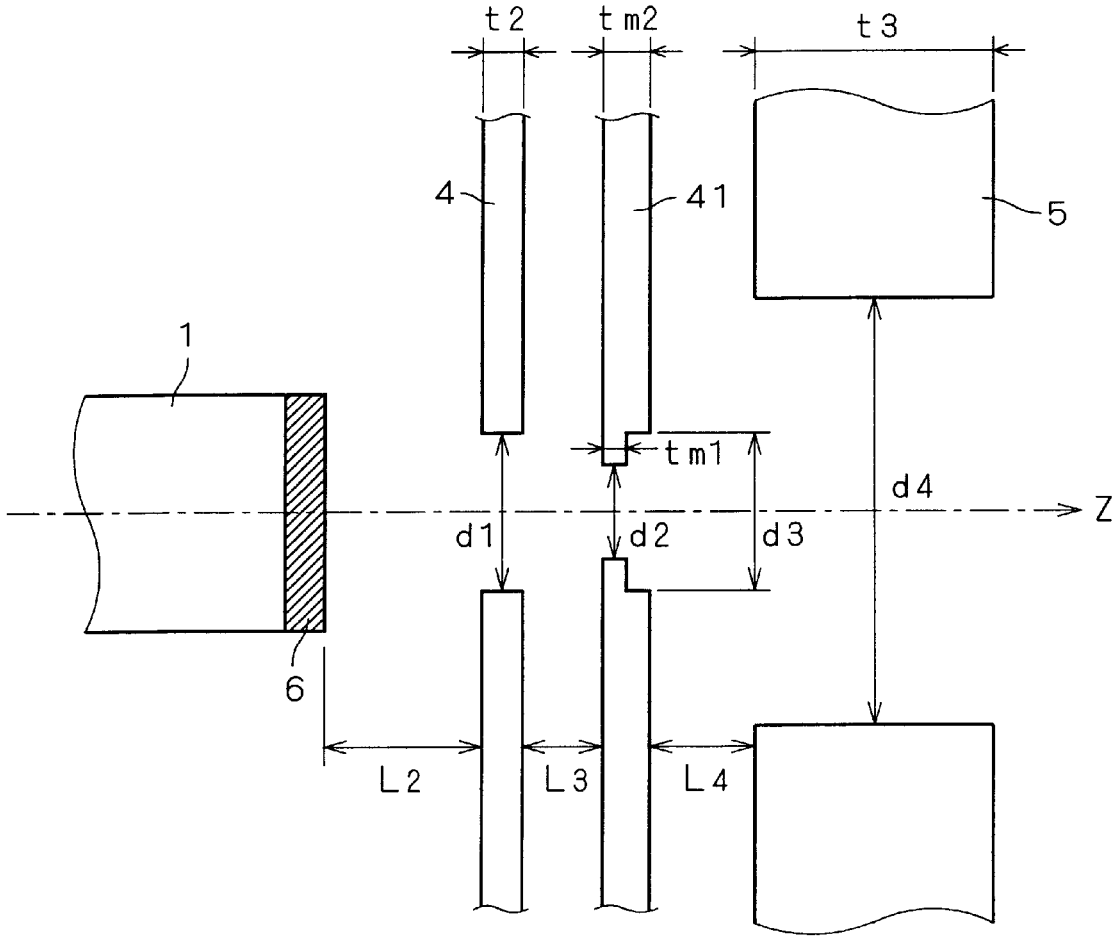
FIG. 1 is a cross-sectional configuration of a CRT electron gun according to Embodiment 1 of the present invention.

FIG. 1 is a cross-sectional configuration of a CRT electron gun according to Embodiment 1 of the present invention and shows an enlarged cross-sectional configuration of the vicinity of a cathode of the electron gun. In FIG. 1, 1 denotes a cathode for inducing electrons toward a screen, 4 denotes a G2 electrode, and 5 denotes a G3 electrode. In this configuration the individual electrodes are arranged on the same axis, and electron current transferred from the cathode 1 is permitted to flow through circular openings of the individual electrodes. The reference symbol 6 denotes an electron-emitting material provided on a surface of the cathode 1. The symbol 41 denotes a Gm electrode provided between the G2 electrode 4 and the G3 electrode 5. There are provided other components such as electrodes provided subsequent to the G3 electrode 5, for example, a G5 electrode and a G6 electrode although they are not shown in the figure.

Hereinbelow, a description will be given of the shapes, materials, and the like of the individual electrodes.

First of all, among the thicknesses of the individual electrodes, t2 of the G2 electrode is about 0.1 mm; t3 of the G3 electrode is about 0.5 mm; tm1 of a portion forming an electron-passing opening of the Gm electrode is about 0.1 mm; and tm2 of portion on the anode side of the Gm electrode, which has a diameter larger than that of the electron-passing opening and has a relatively large thickness, is about 0.25 mm. The materials of the individual electrodes are stainless steel, iron-nickel alloys, and the like. Among the distances between the individual electrodes, a distance L2 between the cathode 1 and the G2 electrode 4 is about 0.4 mm, a distance L3 between the G2 electrode 4 and the Gm electrode 41 is about 0.1 mm, and a distance L4 between the Gm electrode 41 and the G3 electrode 5 is about 0.9 mm. Among the diameters of the electron-passing openings of the individual electrodes, a diameter d1 of an opening portion of the G2 electrode 4 is about 0.3 mm, a diameter d2 of an opening portion of the Gm electrode 41 is about 0.15 mm, and a diameter d4 of a portion wherefrom the plate thickness of the Gm electrode 41 begins to be larger is about 0.4 mm, and a diameter d4 of an opening portion of the G3 electrode 5 is about 1.3 mm.

Hereinbelow, a description will be given of operation.

Figure 2:
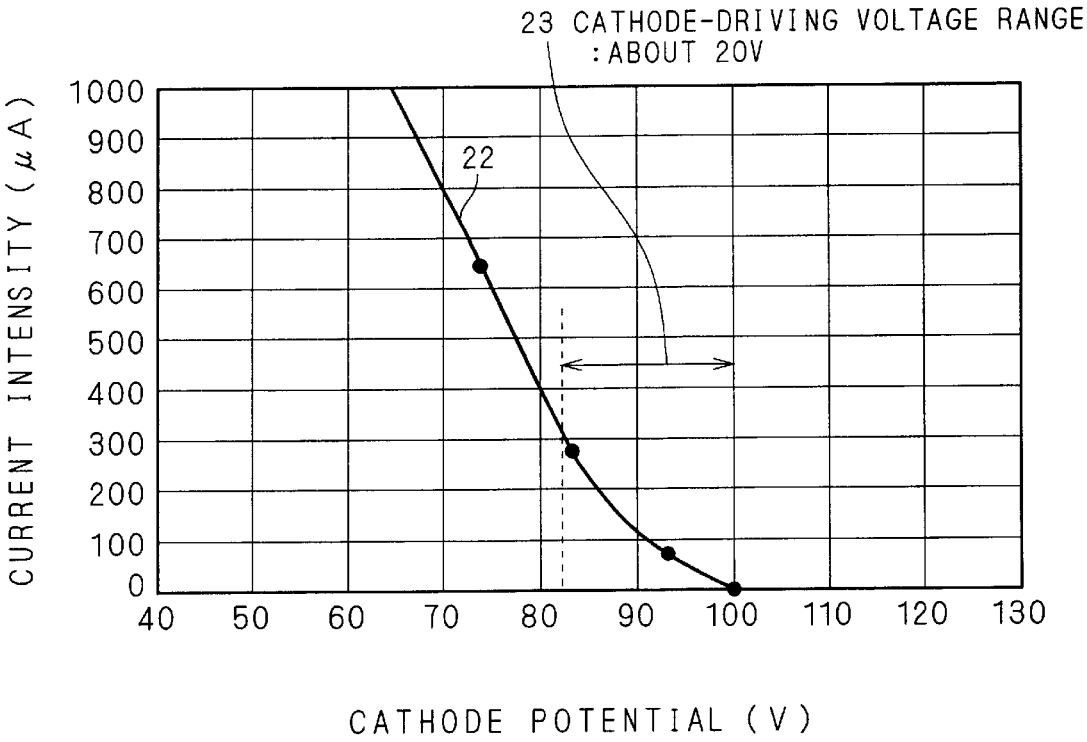
FIG. 2 is an explanatory drawing showing control conditions for electron current in the electron gun of Embodiment 1 according to the present invention.

FIG. 2 is an explanatory drawing showing conditions for controlling electron current in the CRT electron gun according to Embodiment 1 of the present invention. In the figure, the horizontal axis represents a modulation voltage of the cathode 1 (V), and the vertical axis represnts the current intensity ($\mu$A) of the current which flows to the screen. In FIG. 2, 22 denotes a current traveling toward a screen in the electron gun of the present embodimemt. Electrons larger in the amount than the current 22 is emitted from the cathode 1, and the current corresponding to the difference from the current 22 flows to the Gm electrode 41. The refernce sysmbol 23 denotes a range of a potential for performing control when current in a range of 0 to 300 $\mu$A is transferred via the cathode 1 to the screen.

In the present embodiment, a potential higher than the cathode 1, for example, 500 V, is applied to the G2 electrode 4; a predetermined potential of, for example, 100 V, is applied to the Gm electrode 41; and a potential of, for example, 7 kV, is applied to the G3 electrode 5. At this time, according to application of a potential in a range of 100 V to 80 V, as shown in the range 23 in FIG. 2, the electron current in the range of 0 to 300 $\mu$A is obtained.

As described above, in a cathode operation voltage range, the amount of emission current from the cathode is larger than the current flowing to the screen; and although the amount of current flowing to the screen is zero even when the potential of the cathode 1 is 100 V, electron keeps flowing from the cathode 1 which implies that the cathode side of the Gm electrode 41 is in a state of having much electron.

Figure 3:
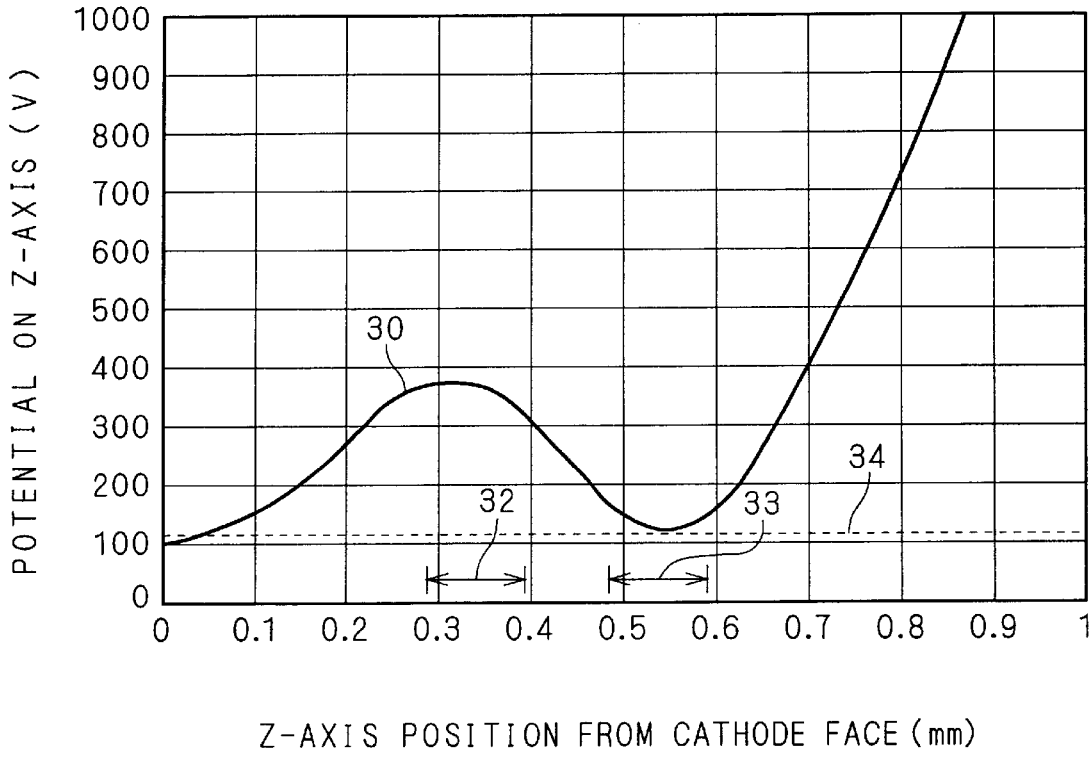
FIG. 3 is an explanatory drawing showing a potential distribution on a Z axis in the CRT electron gun according to Embodiment 1 of the present invention.

FIG. 3 is an explanatory drawing showing a potential distribution on the Z axis in the vicinity of the cathode when electron current flowing to the screen is zero in the CRT electron gun according to the present embodiment of the present invention. In the figure, the horizontal axis denotes the position (mm) on the Z axis from the cathode face, and vertical axis denotes the potential on the Z axis. The reference symbol 30 denotes potentials at individual positions, 32 denotes a range where the G2 electrode 4 exists, 33 denotes a range where the Gm electode 41 exists, and 34 denotes the lowest potential range. In the present embodiment, the Gm electrode 41 is provided near a postion of about 0.5 mm from the surface of the cathode 1 on the Z axis, in which the potential 30 is about 100 V (broken Line). When the cathode potential drops to be lower than 100 V, electrons are permitted pass through; whereas, when the cathode potential rises to be higher than 100 V, electorns are not premitted pass through.

As shown in FIG. 3, the configuration is made such that the lowest potential in which the Gm electrode 41 exists on the Z axis substantially matches the maxiumum potential in the range where the cathode potential varies. In this case, if the potential where the Gm electrode 41 exists on the Z axis is excessively low, electrons are not permitted at all to travel in the direction of the screen. Conversely, if the potential where the Gm electrode 41 exists on the Z axis is excessively high, the potential on the Z axis does not have the minimum value as the potential 34 in FIG. 3, and simply increases. Therefore, since the total amount of the electrons flows to the screen as in the case of the conventional gun, the driving voltage cannot efficiently be reduced.

Generally, the diameter of an electron-passing opening is larger relative to the plate thickness of the electrode, the potential in the electron-passing opening of the Gm electrode is greatly influenced by positions and potentials of the electrodes existing in the vicinity thereof. Therefore, an electron gun must be constructed with high positional precision to provide it with a designed potential. However, in the present embodiment 1, the diameter of the electron-passing opening of the Gm electrode is 0.15 mm, which is the same value as that of the plate thickness of the Gm electrode. In this construction, the potential in the electron-passing opening of the Gm electrode becomes substantially the same as the potential applied to the Gm electrode, thereby allowing the electron gun having less variation in the potential to be configured.

According to the configuration, as shown in FIG. 3, the operation range of the cathode 1, much electrons always exist on the side of the cathode 1 of the Gm electrode 41. In addition, as shown in FIG. 3, a potential gradient (potential (V) on the Z axis/positon (m) on the Z axis) after the Gm electrode 41 is passed is a $10^6$(V/m) order, which is one digit greater than a potential gradient between the conventional cathode 1 and the G1 electrode 2; ad after electrons pass through the vicinity of the Gm electrode 41, much electrons are permitted to travel in the screen direction without influence of space charge. Therefore, the current flowing to the screen varies depending on the amount of electrons permitted to pass through the lowest-potential area on the Z axis where the Gm electrode 41 exists, and control for varying the passing electrons in the range of 0 to 300 $\mu$A can be implemented by driving the cathode potential in a range less than the conventional range.

In addition, with the same driving voltage as the conventional voltage, a current twice greater can be obtained.

According to the present embodiment, the electron gun that allows current for the screen to be drawn at a high sensitivity to the cathode driving voltage can be obtained.

In Embodiment 1, a large-plate-thickness portion on the anode side of the Gm electrode is provided to reduce the divergence angle of electron traveling toward the screen. To obtain high-precision images, the area of the screen onto which electron hits at any moment (which will be called a spot size, hereinbelow) is preferably smaller. To obtain a small spot size, it is advantageous that the divergence angle is small.

Also, the present invention controls the amount of electrons flowing to the screen by varying the voltage of the cathode 1; however, the present invention can perform the control also by varying the potential of the Gm electrode 41. However, according to a method for modulating the potential of the Gm electrode 41, since, for example, when three cathodes 1 for individual R, G, and B exist in a color CRT, the invidividual, R, G, and B must be driven independently of each other, the Gm electrode 41 must be divided into three pieces. In the case where the Gm electrode 41 is divided into three pieces, producing and fixing of the electrodes, wiring, and the like are difficult; whereas the producing is much easier in the case of the electron gun that performs the control according to the voltage fo the cathode 1 as in the present embodiment 1.

The present embodiment has been described with reference to the operational conditions of the CRT electron gun for the display monitor. However, the present invention produces similar effects for electron guns intended for TV CRTs and the like.

Embodiment 2

Figure 4:
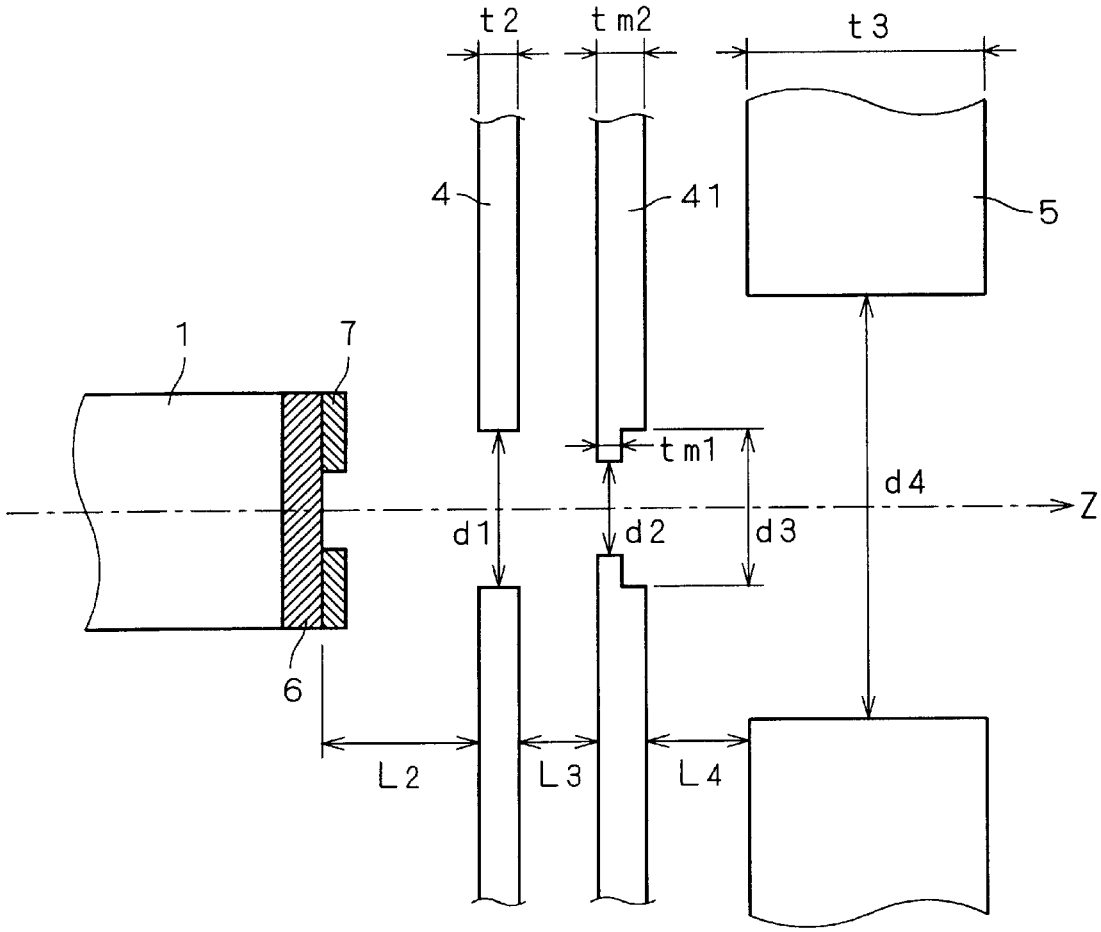
FIG. 4 is a cross-sectional configuration view showing a CRT electron gun according to Embodiment 2 of the present invention.

FIG. 4 is an enlarged cross-sectional configuration view showing the vicinity of a cathode of an electron gun according to Embodiment 2 of the present invention. In the figure, 7 denotes a metal plate that has a circular electron-passing opening and that is provided on a surface of the cathode. The electron-passing opening shares the same axis with individual electron-passing openings of a G2 electrode and a Gm electrode. The thickness of the metal plate is about 0.1 mm, and the diameter of the electron-passing opening is about 0.2 mm. Other things regarding the configuration are the same as Embodiment 1.

According to the configuration of the present embodiment, the electron gun that allows current for the screen to be drawn at a high sensitivity to the cathode driving voltage can be obtained the same as in Embodiment 1 and, in addition, allows the following effects to be obtained. First of all, electrons are not emitted from a cathode-surface of a portion covered by a metal plate 7, but electrons are emitted only from a portion corresponding to the opening, that is, the electron-passing opening; therefore, a load exerting on the cathode can be reduced. In addition, since electrons flowing to the G2 electrode decrease, evaportion of bas that can cause damage on the cathode can be reduced. Furthermore, power consumption can be reduced.

Embodiment 3

Figure 5:
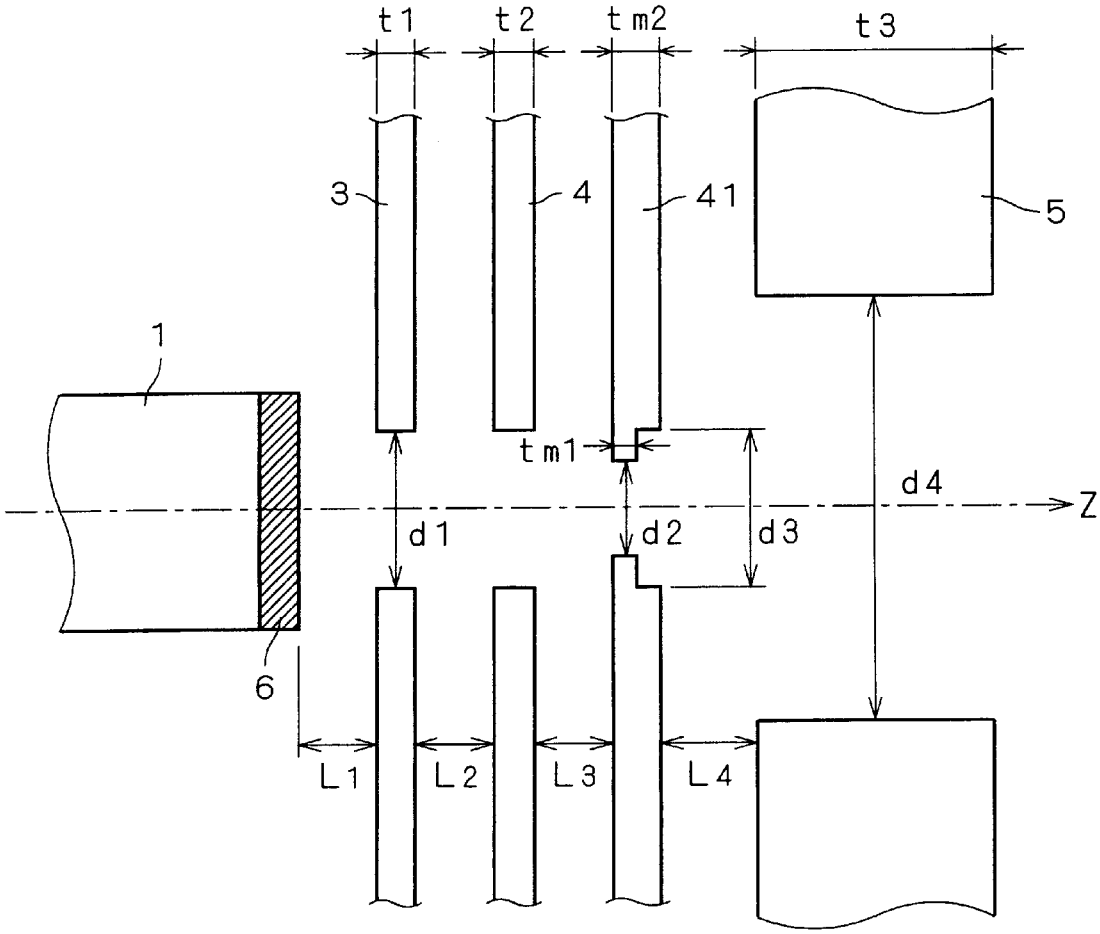
FIG. 5 is a cross-sectional configuration view showing a CRT electron gun according to Embodiment 3 of the present invention.

FIG. 5 is an enlarged cross-sectional configuration view showing the vicinity of a cathode of an electron gun according to Embodiment 3 of the present invention. In a figure, 1 denotes a cathode for inducing electrons in the direction of a screen, 3 denotes a G1 electrode, 4 denotes a G2 electrode, 41 denotes a Gm electrode, and 5 denotes a G3 electrode; the individual electrodes are arranged on the same axis; and electron current transferred from the cathode 1 passes through a circular opening of the individual electrodes. 6 denotes an electron-emitting material provided on a surface of the cathode 1.

In Embodiment 3, the G1 electrode 3 is provided between the cathode 1 and the G2 electrode 4. A plate thickness t1 of the G1 electrode 3 is about 0.08 mm, and the material thereof is stainless steel or an iron-nickel alloy and the like. Among distances, a distance L1 between the cathode 1 and the G1 electrode 3 is about 0.08 mm, a distance L2 between the G1 electrode 3 and the G2 electrode 4 is about 0.12 mm, and a diameter d1 of the opening portion of the electron-passing opening is about 0.4 mm. Other portions are the same as Embodiment 1. A potential of 0 V, which is lower than that of the cathode, is applied to the G1 electrode 3.

According to the configuration of Embodiment 3, the electron gun that allows current for the screen to be drawn at a high sensitivity to the cathode driving voltage can be obtained the same as in Embodiment 1 and, in addition, allows the following effects to be obtained. First of all, electrons are not emitted from a portion other than the opening of the G1 electrode 3, that is, the electron-passing opening; therefore, a load exerting on the cathode can be reduced. In addition, since electrons flowing to the G2 electrode decrease, evaporation of bas that can cause damage on the cathode can be reduced. Furthermore, power consumption can be reduced.

Embodiment 4

Figure 6:
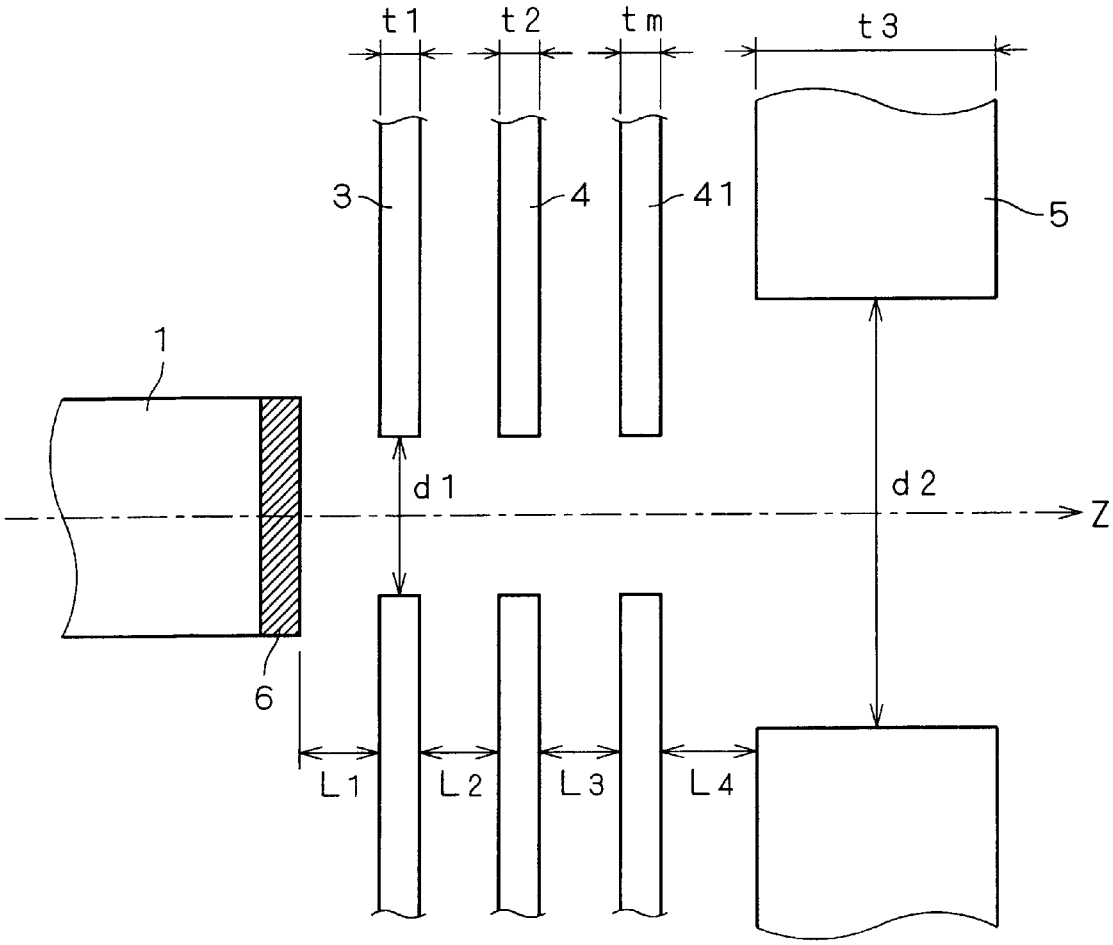
FIG. 6 is a cross-sectional configuration view showing a CRT electron gun according to Embodiment 4 of the present invention.

FIG. 6 is an enlarged cross-sectional configuration view showing the vicinity of a cathode of an electron gun according to Embodiment 4 of the present invention. Among the shapes of individual electrodes, a plate thickness t1 of a G1 electrode 3 is about 0.08 mm, a thickness t2 of a G2 electrode 4 is about 0.1 mm, a thickness tm of a Gm electrode 41 is about 0.1 mm, and a thickness t3 of a G3 electrode 5 is about 0.5 mm. Among the distances between the individual electrodes, a distance L1 between a cathode 1 and the G1 electrode 3 is about 0.08 mm, a distance L2 between the G1 electrode 3 and the G2 electrode 4 is about 0.1 mm, a distance L4 between the G2 electrode 4 and the Gm electrode 41 is about 0.1 mm, and a distance L5 to the G3 electrode 5 is about 1 mm. The diameters of electron-passing openings are set as d1=0.4 mm regarding the G1 electrode 3, the G2 electrode 4, and the Gm electrode 41; and d2=1.3 mm for the G3 electrode 5.

Voltages are applied as: 100 V to 80 V to the cathode, 0 V to the G1 electrode 3,700 V to the G2 electrode 4, −210 V to the Gm electrode 41, and about 7 kV to the G3 electrode.

As described in Embodiment 1, a potential distribution on the Z axis must be caused to have the minimum value in the portion where the Gm electrode exists in order to obtain the high-sensitive electron gun of the present invention. As described above, when the cathode potential is reduced lower than the minimum value, electron begins to flow to the screen. Practically, designing is carried out so that the aforementioned voltage becomes in a range of 70 V to 130 V. In Embodiment 4, the Gm electrode is sandwiched between the G2 electrode 4 to which 700 V is applied and the G3 electrode 5 to which 7 kV is applied, and concurrently, the diameter of the electron-passing opening thereof is 0.4 mm, which is considerably larger than the plate thickness of 0.1 mm. Therefore, to cause the potential in the electron-passing opening of the Gm electrode to be the described predetermined value, a negative potential must be applied to the Gm electrode. According to the application of the negative potential to the Gm electrode, an electron gun that prevents current from flowing to the Gm electrode can be obtained. The arrangement in which the current does not flow to the Gm electrode from the cathode may facilitate power design. In addition, the arrangement allows gas that can cause damage on the cathode to be prevented from evaporating from the Gm electrode.

According to the present embodiment configured as Embodiment 4, the electron gun that allows current for the screen to be drawn at a high sensitivity to the cathode driving voltage can be obtained, as in Embodiment 1; and furthermore, the electron gun that prevents the current from flowing to the Gm electrode can be obtained.

Embodiment 5

Figure 7:
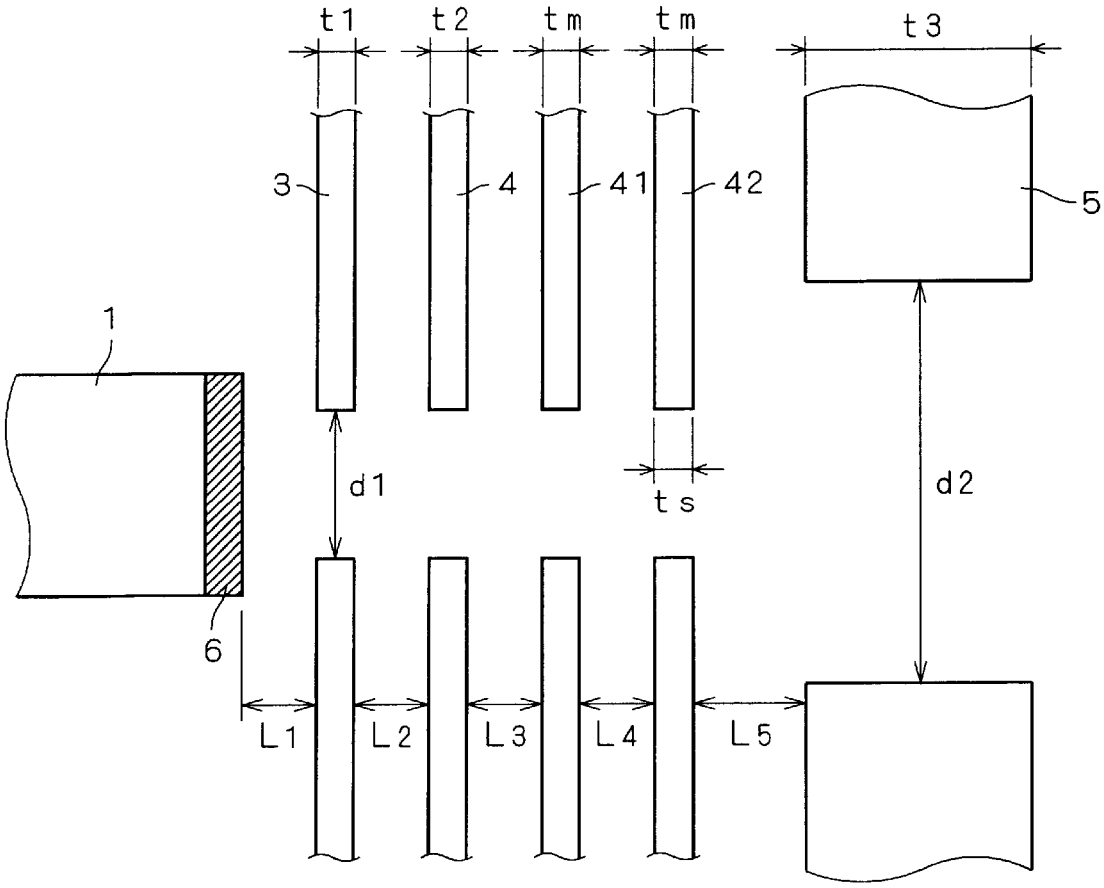
FIG. 7 is a cross-sectional configuration view showing a CRT electron gun according to Embodiment 5 of the present invention.
Figure 8:
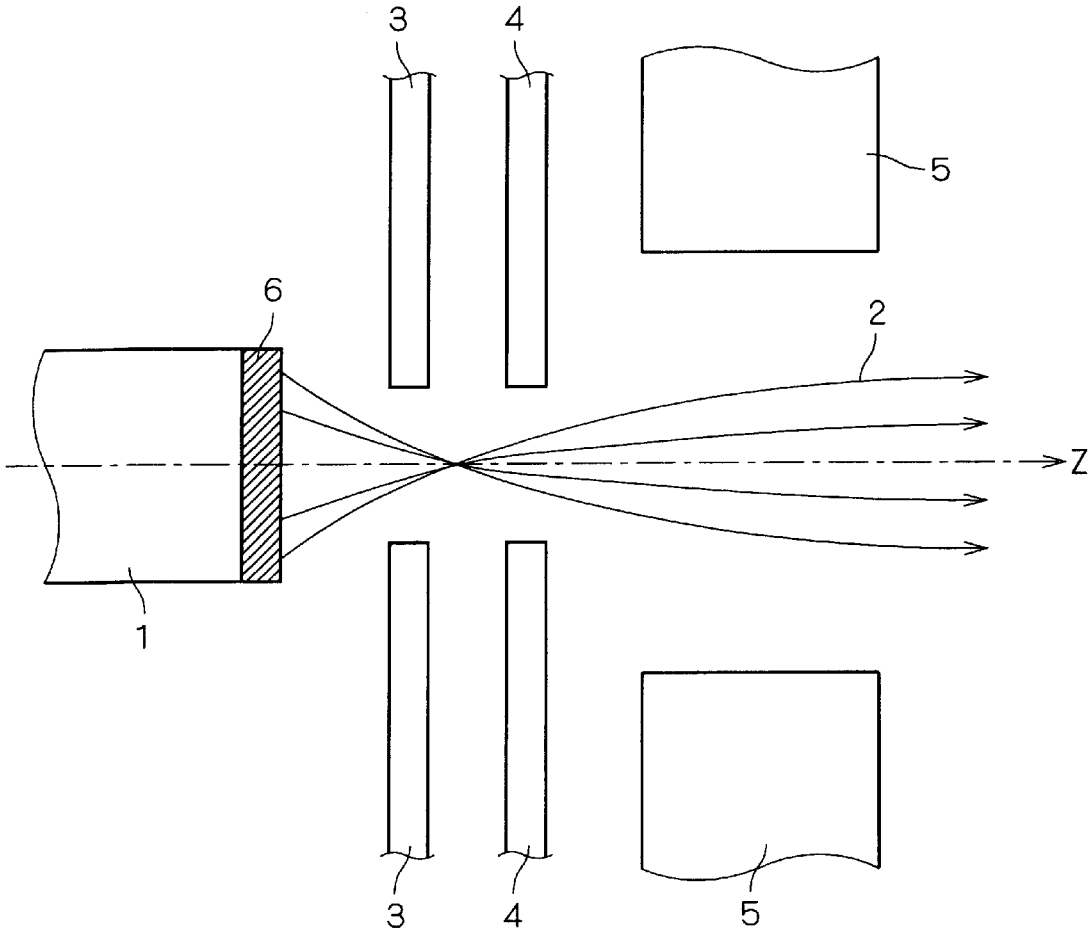
FIG. 8 is a cross-sectional configuration view showing a conventional CRT electron gun.
Figure 9:
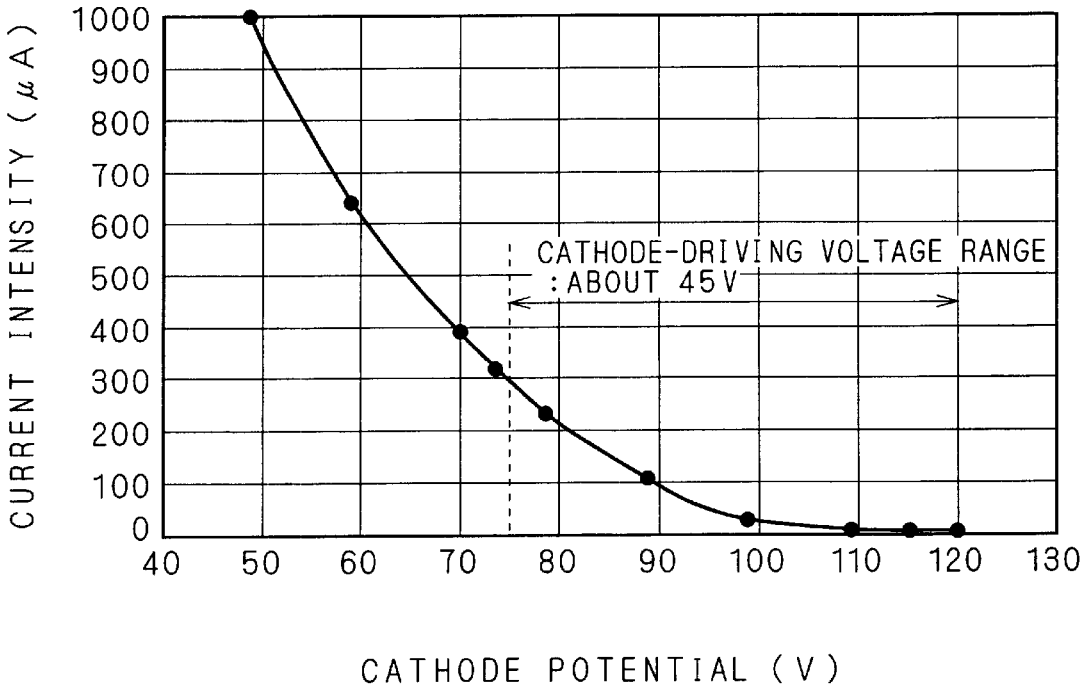
FIG. 9 is an explanatory drawing showing the relationship between a driving voltage and an emission current regarding the conventional CRT electron gun.
Figure 10:
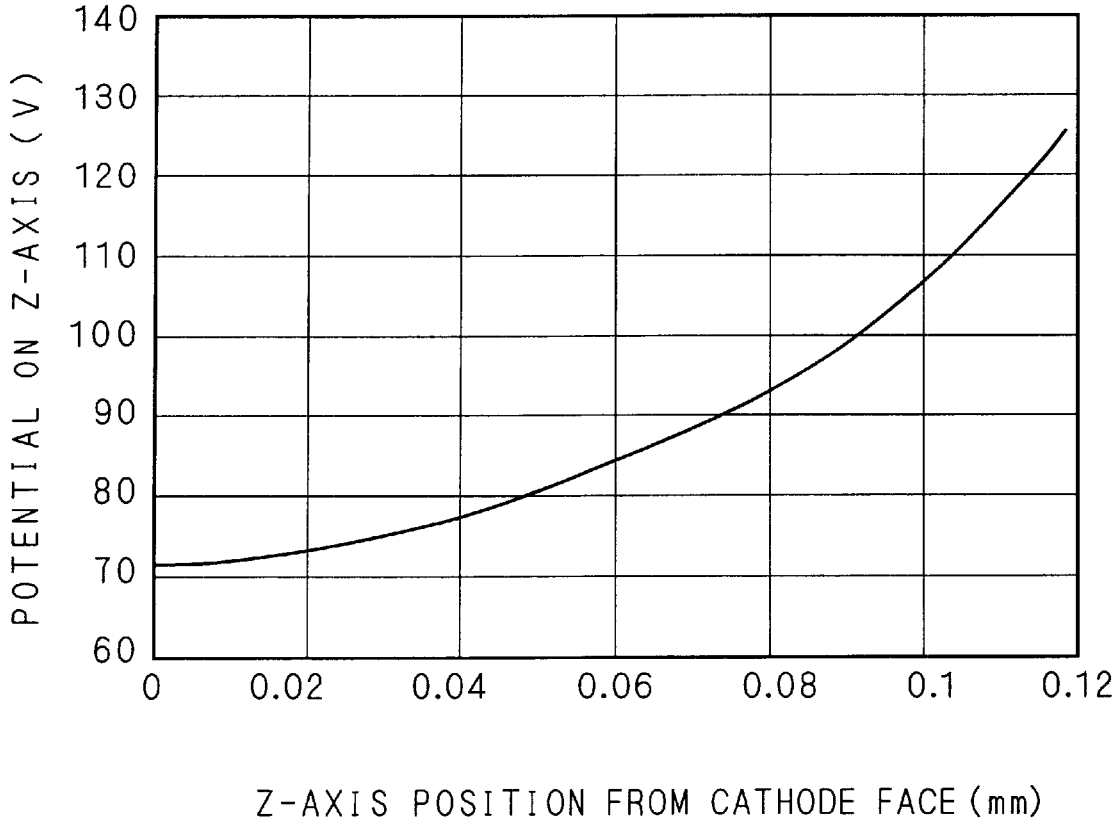
FIG. 10 is an explanatory drawing showing a potential distribution on a rotational symmetric axis in the vicinity of a cathode in the conventional CRT electron gun.

FIG. 7 is an enlarged cross-sectional configuration view showing the vicinity of a cathode of an electron gun according to Embodiment 5 of the present invention. Among the shapes of individual electrodes, a thickness t1 of a G1 electrode 3 is about 0.08 mm, a thickness t2 of a G2 electrode 4 is about 0.1 mm, a thickness tm of a Gm electrode 41 is about 0.1 mm, a thickness ts of a Gs electrode 42 is about 0.1 mm, and a thickness t3 of a G3 electrode 5 is about 0.5 mm. The Gs electrode 42 is provided between the Gm electrode and G3 electrode. As the distances for the individual electrodes, a distance L1 between a cathode 1 and the G1 electrode 3 is about 0.08 mm, a distance L2 between the G1 electrode 3 and the G2 electrode 4 is about 0.1 mm, a distance L3 between the G2 electrode 4 and the Gm electrode 41 is about 0.1 mm, a distance L4 between the Gm electrode and the Gs electrode is about 0.15 mm, and a distance L5 to the G3 electrode 5 is about 1 mm. The diameters of electron-passing openings are set as d1=0.4 mm regarding the G1 electrode 3, the G2 electrode 4, the Gm electrode 41 and the Gs electrode; and d2=1.3 mm for the G3 electrode 5.

Voltages are applied as: 70 V to 85 V to the cathode, 0V to the G1 electrode 3,700 V to the G2 electrode 4 and a Gs electrode 42, −210 V to the Gm electrode 41, and about 7 kV to the G3 electrode.

As in the case of Embodiment 4 described above, when the diameter of the electron-passing opening of the Gm electrode is larger than the plate thickness of the Gm electrode, the potential of the electron-passing opening of the Gm electrode is apt to be influenced by the potentials of electrodes existing in the vicinity thereof. Adjustment for the spot size on the screen (which will be called focus adjustment, hereinbelow) to be most appropriate is performed by varying the voltage of the G3 electrode. However, in Embodiment 4, a problem is caused in that, when the voltage of the G3 electrode is varied to perform the focus adjustment, the potential in the electron-passing opening of the Gm electrode is varied; therefore, the cathode voltage at which current begins to flow to the screen and the amount of current flowing onto the screen are also varied, thereby causing difficulty in the focus adjustment.

In Embodiment 5, the Gs electrode is provided between the Gm electrode and the G3 electrode, thereby allowing reduction in the influence of the variation in the voltage of the G3 electrode to the potential in the electron-passing opening of the Gm electrode. Therefore, the focus adjustment can easily be performed.

The configuration arranged as Embodiment 5 allows the electron gun to be obtained that, as in Embodiment 1, allows current for the screen to be retrieved at a high sensitivity to the cathode driving voltage can be obtained, in addition, that prevents current from flowing to the Gm electrode, and furthermore, that allows focus adjustment to be easily performed.

In the above-described embodiment, although the G2 electrode 4 and the Gs electrode 42 are arranged so as to have the same potential, the potential of the Gs electrode 42 need not be the same as that of the G2 electrode 4. However, in a configuration in which a potential differing from those of the individual electrodes is applied to the Gs electrode 42, the number of wirings is resultantly increased by one. Regarding the number of wirings extended to the outside from the inside of a CRT glass vessel is preferably as small as possible in view of maintaining interelectrode voltage-withstanding characteristics and hermetic characteristics. Therefore, in the present embodiment, the potential of the Gs electrode 42 has been arranged to be the same as that of the G2 electrode 4.

Industrial Applicability

The CRT electron gun of the present invention may also be applied to high-luminance and high-resolution display monitor tubes, TVs, and the like.

What is claimed is:

1. A CRT electron gun having a cathode for emitting electron toward a screen as a display face, a G2 electrode to which a voltage higher than that of said cathode is applied, a Gm electrode to which a predetermined voltage is applied, and a G3 electrode to which a voltage higher than that of said G2 electrode is applied, wherein at least those three electrodes are provided with an electron-passing opening and are arranged on a same axis in that order from a side of said cathode, and a potential of said cathode is varied to vary an amount of electron to be drawn, characterized in that a lowest potential on said axis in a portion where said Gm electrode exists substantially agrees with a maximum potential in a range where a potential of said cathode varies, and a part of said electrons drawn from said cathode flows into at least one of said G2 electrode and said Gm electrode.

2. The CRT electron gun according to claim 1, characterized in that a metal plate that does not emit electron is provided on a surface of said cathode.

3. The CRT electron gun according to claim 1, characterized by comprising a G1 electrode provided with an electron-passing opening to which a voltage lower than that of said cathode is applied, between said cathode and said G2 electrode.

4. The CRT electron gun according to claim 1, characterized in that a screen side of said electron-passing opening of said Gm electrode is provided with a circular portion of a larger plate thickness having a central axis identical to a central axis of said electron-passing opening.

5. The CRT electron gun according to claim 1, characterized in that a Gs electrode for preventing variations in potential distribution in said electron-passing opening of said Gm electrode is provided between said Gm electrode and said G3 electrode.

6. The CRT electron gun according to claim 5, characterized in that the same potential as that of said second grid electrode is applied to said shield electrode.

* * * * *